United States Patent [19]

Smilow et al.

[11] Patent Number: 4,597,207

[45] Date of Patent: Jul. 1, 1986

[54] IDENTIFICATION TAG

[76] Inventors: George Smilow, 16821 Pinata Dr., San Diego, Calif. 92128; Samuel L. Kayen, 116 Nassau St., Elmont, N.Y. 11003

[21] Appl. No.: 628,428

[22] Filed: Jul. 6, 1984

[51] Int. Cl.[4] ..... G09F 3/08

[52] U.S. Cl. ..... 40/20 R

[58] Field of Search ..... 40/20 R, 11 R, 329; 24/30.55, DIG. 9

[56] References Cited

U.S. PATENT DOCUMENTS

| | | | |
|---|---|---|---|
| 1,294,595 | 2/1919 | Allen | 40/20 R |
| 2,222,535 | 11/1940 | Henry, Jr. | 40/20 R |
| 2,590,166 | 2/1950 | Farrell | 24/DIG. 9 |
| 2,721,408 | 10/1955 | Harris et al. | 40/20 R |
| 2,907,586 | 10/1959 | Paxton et al. | 40/20 R |

*Primary Examiner*—Robert Peshock
*Assistant Examiner*—Cary E. Stone
*Attorney, Agent, or Firm*—Robin, Blecker & Daley

[57] ABSTRACT

An identification tag is in a form of a unitary flat body having a display expanse disposed outside the perimeter of a garment and a retaining portion including mutually deflectable members which receive a garment therebetween. One of the deflectable members is adapted further for receipt of a separate garment part. In a particular application the deflectable members biasingly receive the waistband of trousers therebetween and one member further engages a belt loop of the garment.

19 Claims, 4 Drawing Figures

IDENTIFICATION TAG

FIELD OF THE INVENTION

This invention relates generally to identification tags and garments display therewith and pertains more particularly to tags releasably attachable to garments for indicating size characteristics thereof.

BACKGROUND OF THE INVENTION

A present custom in retail clothing establishments is to hang garments, such as trousers, from a support rod in common waist size catagories and to provide disc-like display dividers on the rod, which display the common waist size of the grouping of trousers successive to one display divider and preceding the next display divider. The trousers so grouped are of diverse pants length. For length information, a customer is required to view a sizing label, sewn or otherwise attached to the each of the garments, by discrete attention to an individual garment, typically by displacing trousers adjacent one another to gain viewing access to the sizing label.

The same practice of handling and separating plural trousers applies in alternate retail clothing establishments wherein trousers of like waist size are grouped on separate display tables. Here again, present display practice does not provide all size information readily viewable without individual handling of garments.

The described display practice is inefficient as time consuming for the customer. To the extent that applicants are aware of alternatives to the described practice and display devices, it is believed that same do not address the problem outlined in effective manner.

SUMMARY OF THE INVENTION

The present invention has as its object the provision of an identification tag which overcomes and alleviates the display problems discussed above.

A more particular object of the invention is to provide an identification tag usable with garments for releaseable but secure attachment to the garment and providing the display of garment characteristics outside the perimeter of the garment.

In attaining these and other objects, the invention provides an identification tag for releasable securement to a garment, the tag comprising an elongate unitary body of plastic material having a base expanse for presenting display indicia and extending longitudinally from one end of the body to an intermediate body location. The body extends longitudinally from such intermediate location in first and second portions, at least one of which is deflectable relative to the body expanse. One of the body portions includes means for receiving a separate or discrete part of the garment and ensnaring same. The first and second body portions are mutually deflected, in applying the tag to a garment, such that the garment is recieved therebetween, the garment being engaged at large biasingly between the first and second body portions, with such discrete parment part nested in such one body portion.

In a particular application, the tag is shown in form adapted for use with trousers and the separate or discrete garment part is a belt loop. The waistband is biasingly received between the first and second body portions and the belt loop is ensnared in one such body portion. The display portion extends outwardly of the waistband to be readily viewed by a consumer.

The foregoing and other objects and features of the invention will be further understood from the following detailed description of a preferred embodiment thereof and from the drawings wherein like reference numerals identify like part throughout.

DESCRIPTION OF THE PREFERRED EMBODIMENT

Figure 1:
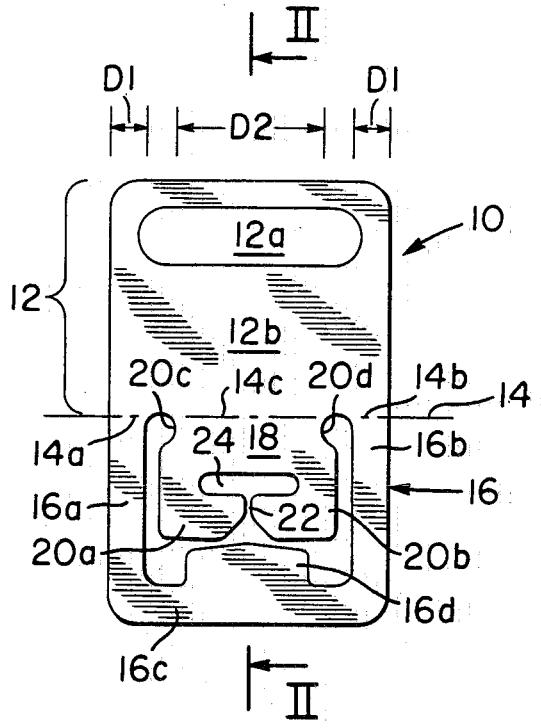
FIG. 1 is a front elevational view of an identification tag in accordance with the invention.
Figure 2:
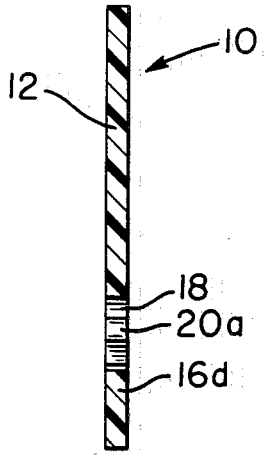
FIG. 2 is a side sectional view of the tag of FIG. 1 as would be seen from plane II—II of FIG. 1.

Turning to FIG. 1, tag 10 is a molded plastic body having a base expanse 12 extending from one end of the body and running longitudinally therewith to an intermediate location indicated generally by fold line 14. Base expanse 12 may include display area **12*a* for presenting the garment source logo. Size information may be imprinted on open surface 12*b*. Body 10 continues longitudinally from fold line 14 in an outer or first body portion 16 which is deflectable relative to base expanse 12 at fold line sections 14*a* and 14*b*. Outer body portion 16 includes arms 16*a* and 16*b* generally of lateral extent D1 and bridged by lateral section 16*c*, which has an extending lip 16*d***.

A second body portion 18 is disposed interiorly of body portion 16 and may be deflectable about fold line 14, particularly section **14*c*, thereof, which has lateral extent D2. Extent D2 is preferably several times larger than extent D1, whereby body portion 16 is more readily deflectable than body portion 18. Second body portion 18 includes a laterally continuous extent adjacent fold line 14 and has second and third laterally spaced extents in the form of detent arms 20*a* and 20*b*, which together define an entry passage 22 at their ends, the passage entering into lateral ensnaring slot 24. At the laterally outward ends thereof, detent arms 20*a* and 20*b* are formed to define, with body portion 16, notches 20*c* and 20*d*, generally coincident with fold line 14**.

Figure 3:
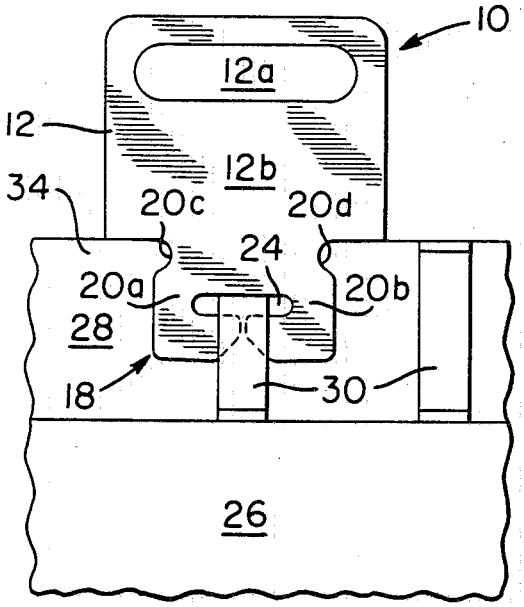
FIG. 3 is an illustrative view, showing the FIG. 1 tag in assembly with a garment, as would be seen from the front side of the garment.
Figure 4:
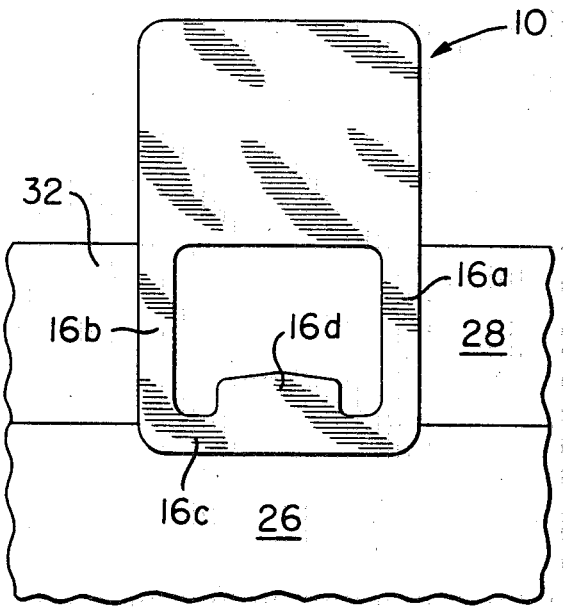
FIG. 4 is a showing, as would be seen from the interior side of the garment, with the tag assembled therewith, as in FIG. 3.

Referring now to FIG. 3, wherein the tag is shown securely applied to garment 26, which is a trousers having a waistband 28 and belt loops 30. In applying tag 10 to garment 26, the aformentioned first and second body portions 16 and 18 are mutually deflected about fold line 14 such that they lie in facing relation, respectively to waistband interior side 32 (FIG. 4) and exterior side 34. Tag 10 is cocked clockwise or counterclockwise from its FIG. 3 disposition, while the waistband is between the deflected body portions, such that belt loop 30 can enter passage 22 (FIG. 1) and become resident, as in FIG. 3, in ensnaring or retention slot 24. At that juncture, tag 10 is reoriented to its attitude as in FIGS. 3 and 4. The upper perimeter of the waistband nests tightly in notches **20*c* and 20*d*, tending to oppose any substantial change in the attitude of tag 10, once it is secured with belt loop 30. Body portions 16 and 18 are self-biased toward one another to secure waistband 28 therebetween. As is seen in FIGS. 3 and 4, body expanse 12 of tag 10** is disposed fully outward of the perimeter of the garment, facilitating the viewing of logo and size information thereon.

As will be appreciated, various changes may be made to the particularly disclosed embodiment in fabricating indentification tags and effecting garment display without departing from the invention. By way of example, source logo and size information may of course be included on both sides of the tag. Accordingly, it is to be understood that the depicted and described preferred embodiment is intended in an illustrative and not in a limiting sense. The true spirit and scope of the invention is set forth in the following claims.

We claim:

1. An identification tag for releasable securement to a garment, said tag comprising an elongate unitary body defining a base expanse extending longitudinally from one end of said body to a location intermediate said body one end and a second end thereof, first and second portions of said body extending longitudinally from said base expanse at said location and being mutually deflectably supported by said base expanse for receipt therebetween of said garment to biasingly engage said garment, said second body portion including means for receipt and retention therein of a further separate part of said garment, said means comprising a slot for the receipt of such separate garment part and an entry passage for disposing said separate garment part in said slot.

2. The invention claimed in claim 1 wherein said second body portion is laterally inward of said first body portion.

3. The invention claimed in claim 1 wherein said first body portion is more readily deflectable relative to said body base expanse than said second body portion.

4. The invention claimed in claim 1 wherein said garment is a trousers, inclusive of a waistband and belt loops, and wherein said second body portion is engageable separately with the waistband of said trousers and a belt loop thereof.

5. The invention claimed in claim 1 wherein said first body portion includes first and second arms extending longitudinally from said base expanse, each of said first and second arms being disposed laterally outwardly of said second body portion.

6. The invention claimed in claim 5 wherein said second body portion extends in first laterally continuous extent from said base expanse and in second and third laterally spaced extents from said first extent.

7. The invention claimed in claim 6 wherein said second and third extents comprise arms which mutually define said slot for the receipt of a garment part and said entry passage for disposing said garment part in said slot.

8. The invention claimed in claim 7 wherein said first body portion defines with said arms notches for engagement with said garment.

9. The invention claimed in claim 7 wherein said second body portion has expanse laterally at said intermediate body location in excess of the cumulative lateral expanse

10. In combination, a garment having plural discrete parts and an identification tag for releasable securement to said garment, said tag comprising an eleongate unitary body defining a base expanse extending longitudinally from one end of said body to a location intermediate said body one end and a second end thereof, first and second portions of said body extending longitudinally from said base expanse at said location and being mutually deflectably supported by said base expanse for receipt therebetween of one of said discrete garment parts to biasingly engage said garment one part, said second body portion including means for receipt and retention therein of another of said discrete garment parts, said means comprising a slot for the receipt of such other garment part and an entry passage for disposing said other garment part in said slot.

11. The invention claimed in claim 10 wherein said base expanse is disposed outside of the perimeter of said garment.

12. The invention claimed in claim 10 wherein said second bodyportion is laterally inward of said first body portion.

13. The invention claimed in claim 10 wherein said first body portion is more readily deflectable relative to said body base expanse than said second body portion.

14. The invention claimed in claim 10 wherein said garment is a trousers, inclusive of a waistband and belt loops and wherein said second body portion is engaged with the waistband of said trousers and a belt loop thereof.

15. The invention claimed in claim 10 wherein said first body portion includes first and second arms extending longitudinally from said base expanse, each of said first and second arms being disposed laterally outwardly of said second body portion.

16. The invention claimed in claim 15 wherein said second body portion extends in first laterally continuous extent from said base expanse and in second and third laterally mutually discontinuous extents from said first extent.

17. The invention claimed in claim 16 wherein said second and third extents comprise arms which mutually define said slot for the receipt of a garment part and said entry passage for disposing said garment part in said slot.

18. The invention claimed in claim 17 wherein said second body portion has expanse laterally at said location in said first extent thereof in excess of the cumulative lateral expanse of said second body portion arms.

19. The invention claimed in claim 17 wherein said first body portion defines with said arms notches in engagement with said garment.

* * * * *